United States Patent [19]

Belmain et al.

[11] Patent Number: 4,921,172

[45] Date of Patent: May 1, 1990

[54] ELECTROSTATIC SPRAYER DEVICE FOR SPRAYING PRODUCTS IN POWDER FORM

[75] Inventors: Daniel Belmain, Uriage; Pierre Chabert, Brignoud; Roger Tholome, La Tronche; Pierre Fabre, Grenoble; Jean-Yves Correard, Glieres; Michel Gondrand, Villeneuve-Les-Avignon, all of France

[73] Assignee: Sames S.A., Meylan, France

[21] Appl. No.: 152,552

[22] Filed: Feb. 5, 1988

[30] Foreign Application Priority Data

Feb. 12, 1987 [FR] France ..... 87 01765
Sep. 15, 1987 [FR] France ..... 87 12765

[51] Int. Cl.[5] ..... B05B 5/02
[52] U.S. Cl. ..... 239/698; 239/706
[58] Field of Search ..... 239/692, 693, 697, 698, 239/704, 706–708, 424.5

[56] References Cited

U.S. PATENT DOCUMENTS

| | | | |
|---|---|---|---|
| 3,111,266 | 11/1963 | Axelson et al. | 239/698 |
| 3,540,653 | 11/1970 | Fabre | 239/697 |
| 4,039,145 | 8/1977 | Felici et al. . | |
| 4,228,961 | 10/1980 | Itoh | 239/698 |

FOREIGN PATENT DOCUMENTS

| | | | |
|---|---|---|---|
| 203694 | 12/1986 | European Pat. Off. | 239/698 |
| 2172612 | 9/1973 | France . | |
| 2283729 | 4/1976 | France . | |
| 1038865 | 8/1966 | United Kingdom | 239/706 |
| 1406358 | 9/1975 | United Kingdom | 239/707 |
| 2118865 | 11/1983 | United Kingdom | 239/692 |

*Primary Examiner*—Andres Kashnikow
*Attorney, Agent, or Firm*—Sandler & Greenblum

[57] ABSTRACT

An electrostatic sprayer device for spraying products in powder form comprises an air-powder mixture pipe with an ejector orifice at one end. It has a charging electrode adjacent this orifice and a counter-electrode coaxial with and to the rear of the charging electrode relative to the direction in which the mixture is ejected from the pipe. This counter-electrode is external to the pipe and substantially perpendicular to the axis of the pipe, with the result that an annular space is defined between the two electrodes and around the pipe. The electrodes have a potential difference applied between them to generate an electric field which attracts free ions towards the counter-electrode. A blower adjacent the counter-electrode discharges into the annular space formed between the two electrodes and around the pipe.

28 Claims, 2 Drawing Sheets

ELECTROSTATIC SPRAYER DEVICE FOR SPRAYING PRODUCTS IN POWDER FORM

BACKGROUND OF THE INVENTION

Field of the Invention

The invention relates to an electrostatic sprayer device for spraying products in powder form and in particular coating products entrained by air, the invention being more particularly directed to an improvement which makes it possible to prevent a counter-electrode (the particular function of which is to capture free ions from the air-powder mixture ejected towards an object to be coated) becoming progressively less efficient as it is gradually covered with the coating product forming an insulative film.

Electrostatic powder coating is routinely used in industry, in particular to coat objects with a paint applied in powder form to be subsequently melted by application of heat. When such objects are entirely coated with a sufficient layer of powder, they are routed to an oven in which the powder coating is converted into a homogeneous and strong paint layer as a result of the powder particles melting together, generally followed by polymerization.

For electrically charging the particles of the air-powder mixture an electrical field may be created between a charging electrode placed in the air-powder mixture and a counter-electrode separated from the charging electrode by a distance of a few centimeters. It is also necessary to create a deposition field between the sprayer device and the object to be coated. This is generally achieved by applying a high voltage to the charging electrode and grounding the object. The counter-electrode may itself be grounded or held at an intermediate voltage to create the required field given the dimensions of the sprayer and in particular the distance between the two electrodes.

From this point of view, one requirement is to develop devices using voltages that are not excessively high. In particular, it is desirable to create a charging field over a distance of 30 to 40 mm with a potential difference between the electrodes in the order of 30 kV.

It has been observed that if free ions travel with the air-powder mixture towards the object to be coated, being entrained by the deposition field, differences in the concentration with which the powder is deposited can arise between upstanding and recessed parts of the object. These differences in powder concentration obviously give rise to differences in the thickness of the layer of paint after entry to the oven. It is therefore desirable for substantially all of the free ions which have not served to charge the powder to be recovered by an ion trap, in this instance the counter-electrode. Various configurations have been proposed for the counter-electrode for optimum "recovery" of free ions. Many of the proposed solutions place the counter-electrode inside the air-powder mixture pipe or in direct communication with the interior of this pipe. These solutions are generally somewhat unsatisfactory because the powder tends sooner or later to cover the counter-electrode producing an insulative coating which prevents it fulfilling its function as an ion trap. It is assumed that one of the phenomena involved is local melting of the powder particles resulting from the energy with which they impact on the counter-electrode. To prevent such collection of powder on the counter-electrode it has been proposed to clean it continuously by circulating clean air or even to provide a porous counter-electrode through which air is passed continuously. A solution of this kind is described in U.S. Pat. No. 4,039,145, for example. It has also been proposed to place the electrode outside the air-powder mixture pipe but as yet it has not been possible to prevent particles of powder entrained by vortices covering the counter-electrode. In this line of thinking, U.S. Pat. No. 4,228,961 proposes a structure with an axial cylindrical counter-electrode cleaned by a jet of air passed continuously through a very small annular gap around the counter-electrode. Continuous cleaning of the counter-electrode by this air jet has not yielded good results and this failure may be attributed to the fact that the air jet may itself favor the creation of vortices in the vicinity of the counter-electrode. Moreover, it seems that the shape of this counter-electrode and the small cross-section of the passage that the free ions have to take to reach the counter-electrode significantly reduce the effectiveness of the latter as an ion trap. Also, a passage with a cross-section this small can become clogged in use.

The invention proposes a new arrangement for an electrostatic sprayer device for spraying products in powder from comprising a counter-electrode external to the air-powder mixture pipe whose shape and dimensions enable it to function efficiently as an ion trap, said counter-electrode being associated with blowing means serving, among other things, to clean it continuously. The invention is particularly directed to an arrangement which makes it possible to prevent vortices in the air-powder mixture in the immediate vicinity of the counter-electrode, notably because of the movement of the air intended to clean the counter-electrode.

SUMMARY OF THE INVENTION

The invention consists in an electrostatic sprayer device for spraying products in powder form, comprising an air-powder mixture pipe, an ejector orifice at one end of said pipe, a charging electrode adjacent said orifice, a counter-electrode coaxial with and to the rear of said charging electrode relative to the direction in which said mixture is ejected from said pipe, external to said pipe and substantially perpendicular to the axis of said pipe whereby an annular space is defined around said pipe and extending from said counter-electrode towards said charging electrode, said electrodes being adapted to have a potential difference applied between them to generate an electric field adapted to attract free ions towards said counter-electrode, and blower means adjacent said counter-electrode discharging into said annular space.

In a very simple manner, the aforementioned annular space is defined between the external surface of said air-powder mixture pipe and a sleeve external to and coaxial with this pipe.

Thus the counter-electrode may conveniently have an annular surface perpendicular to the axis of the device that is relatively large and disposed so that free ions in the space occupied by the charging field are virtually all attracted towards it. Because the air is passed along said relatively long annular space, the powder particles that could be attracted towards the counter-electrode because of their charge are repelled by the force of the air jet. The function of the latter is thus not only to clean the counter-electrode but also to prevent the particles of powder reaching it. Moreover, there is no longer any risk of vortices likely to convey powder towards the counter-electrode since there is no possibility of polluted ambient air being drawn in near the counter-electrode.

The invention is also concerned with a particular embodiment of an arrangement of this kind which procures a surprising improvement in the performance of the device.

According to a first aspect of this embodiment, the sleeve delimiting the annular space formed in front of the counter-electrode has a tapered, specifically frusto-conical, configuration: this results in an advantageous and beneficial reduction in the consumption of air and improved penetration of the coating on parts featuring cavities.

According to another aspect of this embodiment the aforementioned sleeve is pierced by a plurality of orifices near the counter-electrode: these orifices create for the air blown over the counter-electrode exhaust channels in a plurality of directions transverse to the spraying direction. These exhaust channels for the blown air improve the effectiveness of the counter-electrode functioning as an ion trap to capture free ions in the air-powder mixture ejected towards the object to be coated.

According to another aspect of this embodiment, the end part of the air-powder mixture pipe has a sharply tapered shape which has the advantage of eliminating virtually all risk of powder accumulating at the ejector orifice, which improves the quality of the coating obtained because of the reduced risk of spraying lumps.

The invention will be better understood and its other advantages will emerge more clearly from the following description of two embodiments of the invention given by way of example only and with reference to the appended drawings.

DESCRIPTION OF THE PREFERRED EMBODIMENTS

Figure 1:
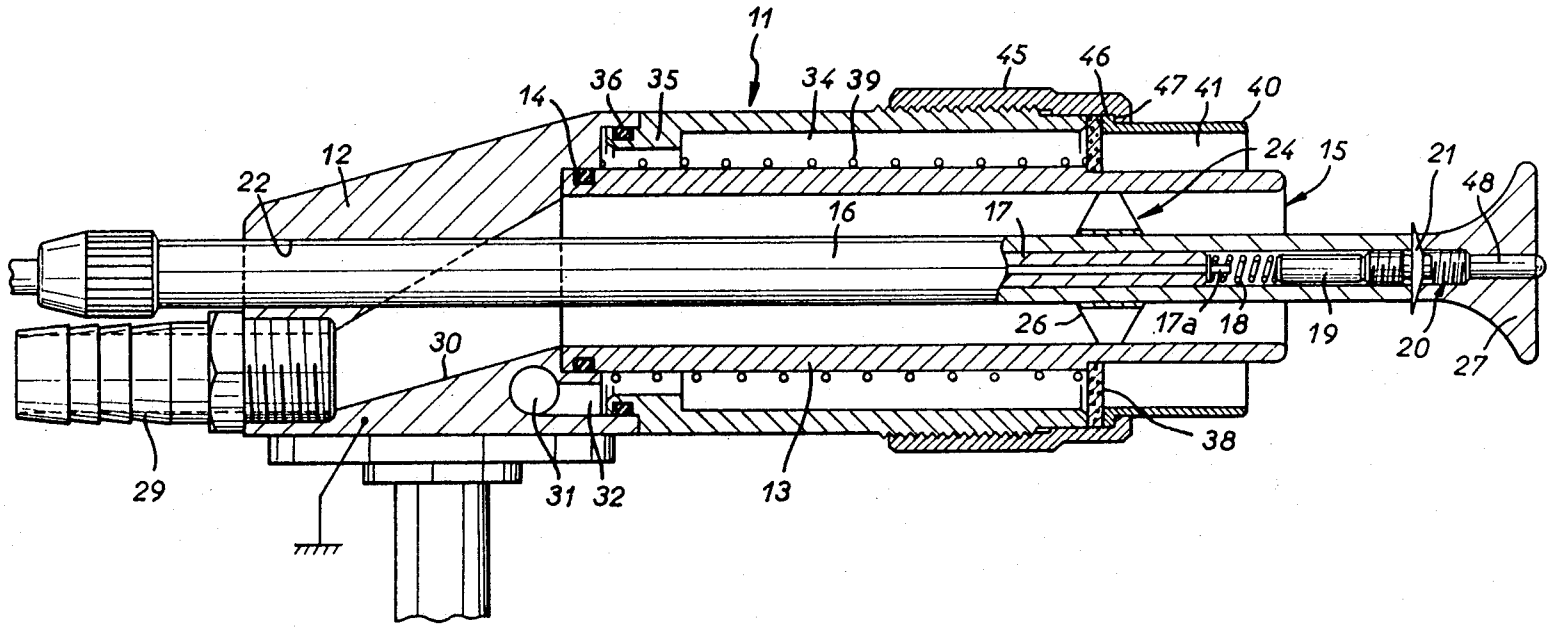
FIG. 1 is a schematic view in longitudinal cross-section of one embodiment of an electro-static sprayer device in accordance with the invention for spraying products in powder form.

The powder sprayer device 11 as shown in FIG. 1 principally comprises a metal body 12 which is electrically grounded and encloses a number of passages and cavities and a cylindrical tubular air-powder mixture pipe 13 sealed at one end to the body 12 by an O-ring 14. The insulative pipe 13 has at its other end an ejector orifice 15 for said air-powder mixture. An insulative rod 16 coaxial with the pipe 13 passes through the body 12 and the pipe 13. It is tubular and encloses a high-tension cable 17 the core 17*a* of which is in contact with a spring 18 making an electrical connection with one end of a resistor 19. The other end of this resistor is in contact with a charging electrode 20 comprising a disk-shaped flange 21 coaxial with the rod 16 and the pipe 13 and substantially perpendicular to the axis. Its circular edge emerges from the lateral surface of the insulative rod 16. The latter is held in its axial position by virtue of being inserted into a bore 22 of the body 12, on the one hand, and into a central bore of a part 24 provided with radial fins 26 bearing against the inside wall of the pipe 13, on the other hand. The charging electrode 20 lies outside the ejector orifice 15, in axial alignment with the air-powder mixture pipe 13. In a way that is known in itself, the insulative rod is extended in the air-powder mixture ejection direction by an enlarged part 27 functioning as a deflector. In this instance the charging electrode 20 is disposed between the cylindrical rod 16 and the enlarged part 27 and, by virtue of threaded portions aligned with one another, constitutes the means for fastening these two elements together. The body 12 is provided with a connector 29 through which the air-powder mixture is fed into an inclined passage 30. This communicates with the end of the pipe 13 attached to the body 12.

Another connector (not visible in the drawing) communicates with bores 31, 32 in the body 12. It is adapted to be connected to a compressed air supply. The bore 32 opens into an annular housing 34 defined between the outside surface of the pipe 13 and a substantially cylindrical pipe section 35 sealed to the body 12 at one end by an O-ring 36. The arrangement (31, 32, 34, 35) forms blowing means for cleaning a counter-electrode 38 disposed external to the pipe 13 in such a way as to close off one end of the annular housing 34. In the device described the counter-electrode is porous, being made of porous bronze, for example. This is known in itself. Thus compressed air fed into the annular housing 34 escapes through said counter-electrode 38. The latter forms a flat annular wall bearing internally against a shoulder on the external surface of said pipe 13 and externally against one end of the pipe section 35. The pipe 13 and the pipe section 35 are made from insulative material and the counter-electrode is held at a chosen potential, in this instance ground potential, by a spring 39 lightly compressed in the annular housing and in contact with the body 12.

According to an important feature of the invention, the counter-electrode external to the pipe 13 and perpendicular to the axis of the latter is protected by an external sleeve 40 which defines with the pipe 13 and around the latter an elongate annular space 41. This is therefore in line with the counter-electrode and faces towards the charging electrode 20 and, since the counter-electrode is porous in this instance, the blowing means defined hereinabove discharge into this annular space 41. The flat annular wall forming the counter-electrode 38 thus runs between the external surface of the pipe and one end of the external sleeve 40. To facilitate assembly the pipe section 35 and the sleeve 40 are axially aligned with each other and the counter-electrode 38 is clamped externally between facing ends of said pipe section 35 and said sleeve 40. To achieve this an internally screwthreaded retaining ring 45 is screwed onto an externally threaded portion of the pipe section 35. It has an internal shoulder 46 at one end which bears against an external shoulder 47 on the sleeve 40. The ring 40 and the sleeve 45 may advantageously be made in one piece.

It has been observed that with this arrangement the force communicated to the charged particles by the air flowing in the sleeve 40, this force depending essentially on the speed at which the air flows in the sleeve and on the surface area of the particles, is greater than the electrical force attracting the same charged particles. These conditions are obtained only when the sleeve is present by virtue of the channelling of the air escaping from the counter-electrode. Also, no vortices likely to entrain the powder can form in the vicinity of the counter-electrode, the vortices being transferred, at worst, towards the front, near the end of the sleeve 40.

A metal rod 48 in electrical contact with the charging electrode 20 (and advantageously constituting an extension of the latter) emerges axially from the end of said enlarged part 27. This particular feature improves the configuration of the deposition field.

It is to be understood that the invention is not limited to the embodiment that has just been described. The sleeve 40 is not necessarily cylindrical; it may be conical, widening towards the counter-electrode 38, which makes it possible to use a larger counter-electrode. If the charging electrode is not held at a very high voltage, the counter-electrode 38 may be grounded. On the other hand, to enable an increase in the voltage applied to the charging electrode so as to increase the deposition field said counter-electrode may be held at an intermediate voltage to avoid any change to the dimensions of the device, in particular the distance between the charging electrode and the counter-electrode. Take the case where, for example, the requirement is to maintain a potential difference of 30 kV between the two electrodes. To increase the deposition field the charging electrode may be held at 90 kV, in which case the counter-electrode is held at 60 kV. Other modifications are possible. In particular, the charging electrode 20 is not necessarily located at the junction between the cylindrical part of the rod 16 and the enlarged part 27. The charging electrode can emerge at any point on said enlarged part and may even consist of a simple metal disk covering the end of the deflector, in which case the rod 48 is eliminated. Or again, consideration may be given to implementing the charging electrode in the form of several spikes, three spikes, for example, regularly distributed in the angular direction and preferably projecting from the periphery of the deflector. Finally, the counter-electrode may be made from a porous metal (porous stainless steel, for example) or from a conductive synthetic material. Nor is it indispensible that it be porous; equally conceivable is a variant in which air passages would circumvent it to establish a circulation of air between the housing 34 and the annular space 41.

Figure 3:
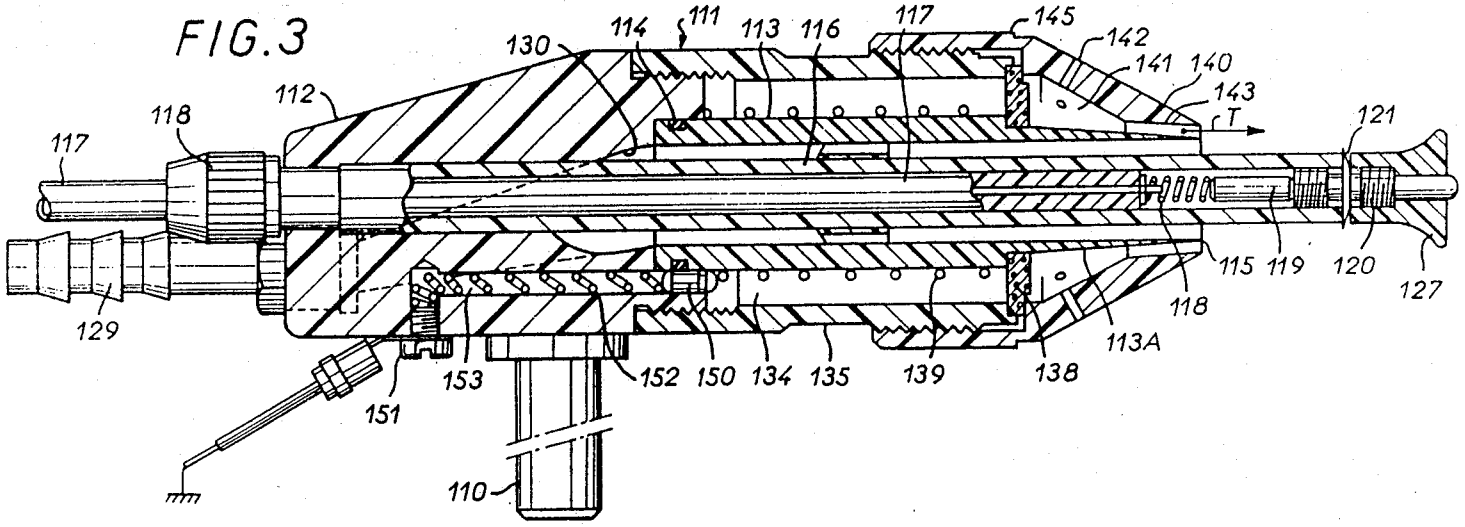
FIG. 3 is a view in longitudinal cross-section on the line III—III in FIG. 2.
Figure 2:
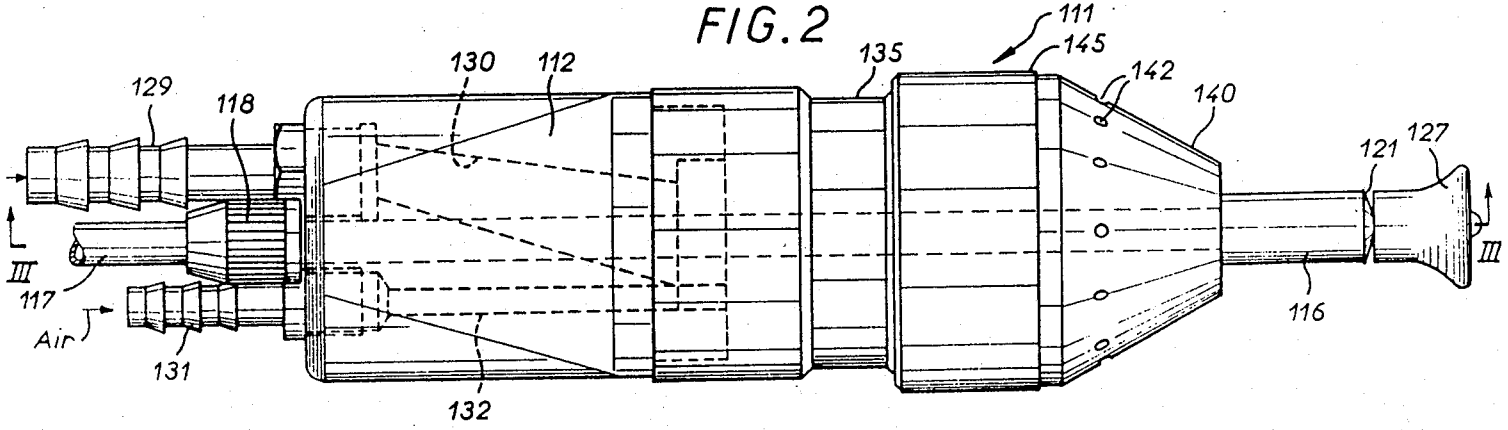
FIG. 2 is a plan view of another sprayer device in accordance with the invention.

Most component parts of the device described with reference to FIG. 1 will be found again in the embodiment of FIGS. 2 and 3, in which similar components are designated by the same reference numbers increased by 100.

The powder sprayer device 111 therefore comprises a rear body 112 assembled to an air-powder mixture pipe 113 terminating at an ejector orifice 115. An insulative rod 116 passes through the body 112 and the pipe 113 with a high-tension cable 117 the core of which is urged by a spring 118 into electrical connection with a resistor 119, in turn in contact with a charging electrode 120 comprising a flange 121 to the rear of a flared end part 127 forming a deflector.

It should be noted that how far the flange 121 projects radially beyond the peripheral surface of the insulative rod 116 and its extension 127 is limited to the value just sufficient for the electrical discharge to form. This projection is in the order of one tenth of a millimeter.

The rear body 112 fitted with a supporting foot 110 is in this instance made from an insulative material. It is provided with a connector 129 through which the air-powder mixture is fed into an inclined and flared passage 130 discharging into the pipe 113. Another connector 131 connected to a compressed air supply leads to a bore 132 which discharges into an annular housing 134 defined between the external surface of the pipe 113 and an external pipe section 135. A counter-electrode 138, made from porous bronze, for example, closes off the anterior end of the annular passage 134. This counter-electrode is held at ground potential by a spring 139 which bears against the rear body 112 through a conductive terminal 150 in turn connected to a grounding terminal 151 through the intermediary of a spring 152 lying in a passage 153 provided in the body 112 for this purpose.

The counter-electrode 138 is held in abutting relationship against surfaces provided for this purpose on the pipe 113, on the one hand, and at the end of the external pipe 135, on the other hand, by means of a sleeve or skirt 140 made in one piece with a skirt nut 145. According to one important characteristic of this embodiment, the sleeve-skirt 140 has a tapered frustoconical shape achieving a significant reduction in the cross-section of the annular space 141. The frustoconical wall of the sleeve-skirt 140 is pierced by a circular row of holes 142 uniformly distributed along the periphery and facing the counter-electrode 138.

The pipe 113 has a strongly tapered end part 113A with a frustoconical external wall, the generatrix of this cone frustum forming with the axial direction an acute angle of low value, approximately 5°, for example.

The frustoconical sleeve-skirt 140 comprises a tapered end part delimited on the radially internal side by a frustoconical wall 143 substantially parallel to the frustoconical end surface 113A so as to define with the latter an annular passage of reduced cross-section constituting a sort of exhaust nozzle T for the annular space 141.

The annular space 141 delimited by the sleeve-skirt 140 in front of the counter-electrode 138 and around the air-powder mixture pipe 113 thus enables the blown-in air that has passed beyond the counter-electrode to escape by two different routes:

- the axial route on which the passage cross-section is strongly reduced and the flow speed accelerated in the exhaust nozzle T;
- the radial route constituted by the series of holes 142 which reduce the pressure in front of the counter-electrode but offer a multiplicity of exhaust routes with flow speeds that will naturally depend on the diameter of the holes.

Experience shows that this arrangement enables a significant improvement in the performance of the sprayer device for many reasons the effects of which combine with each other in a particularly opportune and advantageous manner.

A first observation is an extremely significant improvement in the quality of the coating obtained, in particular on workpieces featuring cavities, as a result of the reduced risk of re-entrainment by the blowing air from the counter-electrode of particles that have already reached the workpiece.

Other things being equal, a significant proportion of this blowing air escapes laterally by the radial route offered by the holes 142, which comensurately reduces the quantity of air exhausting towards the workpiece through the axial nozzle T.

A second benefit is thus an overall reduction in air consumption.

Thirdly, a surprising improvement in the effectiveness of the counter-electrode as a free ion trap is observed, with a reduced probability of unintentional capture of charged particles.

The efficient and regular capture of free ions is reflected in particular by the establishment of a high and stable current (30 microamperes, for example) between the charging electrode and the counter-electrode, which would seem to be primarily due to the lines of force and lines of flow passing through the holes 142.

Protection against unwanted capture of charged particles can be attributed to the high flow speeds through the nozzle T in the axial direction where the electrostatic entrainment forces are highest. Protection is also provided against the risk of particles travelling back through the holes and the air exhaust speeds are lower although the electrostatic entrainment forces are also lower.

The diameter of the holes 142 will generally be between 1 and 4 mm. Excellent results have been achieved with a prototype having 12 holes 3 mm in diameter, offering a total passage cross-section of approximately 85 $mm^2$, while the passage cross-section offered by the nozzle T with an average diameter of 22 mm and a thickness of 2.5 mm is substantially the same.

The sharply tapered shape of the end part 113 of the air-powder mixture pipe avoids in a very effective way the risk of powder accumulating and lumps being sprayed. Equally advantageous in this respect is the similarly tapered shape of the end part 143 of the sleeve-skirt 140 and the continuity of the latter with the skirt nut 145.

There is claimed:

1. Electrostatic sprayer device for spraying products in powder form, comprising an air-powder mixture pipe, an ejector orifice at one end of said pipe, a charging electrode adjacent said orifice, a counter-electrode coaxial with and to the rear of said charging electrode relative to the direction in which said mixture is ejected from said pipe, said counter-electrode being external to said pipe and having a surface substantially perpendicular to the longitudinal axis of said pipe whereby an annular space is defined around said pipe and extending from said surface of said counter-electrode, which communicates with said annular space towards said charging electrode, said electrodes being adapted to have a potential difference applied between them to generate an electric field adapted to attract free ions towards said counter-electrode, and blower means adjacent said counter-electrode discharging into said annular space.

2. Device according to claim 1, wherein said charging electrode is external to said orifice and axially aligned with said pipe.

3. Device according to claim 1, further comprising a sleeve external to said pipe and wherein said annular space is defined between said sleeve and the external surface of said pipe.

4. Device according to claim 3, wherein said counter-electrode forms a flat annular wall extending at least between said external surface of said pipe and said sleeve.

5. Device according to claim 1, wherein said counter-electrode constitutes a porous wall and said blower means comprises a pipe section closed at one end by said porous wall and adapted to be connected to an air supply.

6. Device according to claim 5, wherein said pipe section surrounds said air-powder mixture pipe.

7. Device according to claim 1, wherein said charging-electrode has a part with a circular contour coaxial with said pipe.

8. Device according to claim 7, further comprising an insulative rod coaxial with said pipe and wherein said charging electrode comprises a metal disk the outside edge of which emerges from a lateral surface of said rod.

9. Device according to claim 8, wherein said insulative rod has an enlarged end part adapted to function as a deflector.

10. Device according to claim 9, further comprising a metal rod emerging axially from the end of said enlarged end part and in electrical contact with said charging electrode.

11. Device according to claim 1, further comprising an insulative rod coaxial with said pipe and having an enlarged end part adapted to function as a deflector, and wherein said charging electrode comprises a metal disk mounted at said enlarged end of said rod.

12. Device according to claim 1, wherein said annular space has a predetermined length, and wherein said surface of said counter-electrode defines a rearward end of said annular space whereby air is discharged into said annular space by said blower means through said surface of said counter-electrode.

13. Electrostatic sprayer device for spraying products in powder form, comprising an air-powder mixture pipe, an ejector orifice at one end of said pipe, a charging electrode adjacent said orifice, a counter-electrode coaxial with and to the rear of said charging electrode relative to the direction in which said mixture is ejected from said pipe, external to said pipe and substantially perpendicular to the axis of said pipe whereby an annular space is defined around said pipe and extending from said counter-electrode towards said charging electrode, said electrodes being adapted to have a potential difference applied between them to generate an electric field adapted to attract free ions towards said counter-electrode, blower means adjacent said counter-electrode discharging into said annular space, a sleeve external to said pipe and wherein said annular space is defined between said sleeve and the external surface of said pipe, wherein said counter-electrode constitutes a porous wall and said blower means comprises a pipe section closed at one end by said porous wall and is adapted to be connected to an air supply, and wherein said pipe section and said sleeve are axially aligned and said counter-electrode is clamped externally between facing ends of said pipe section and said sleeve.

14. Device according to claim 13, wherein said pipe section has an externally threaded part and said sleeve comprises an external shoulder and further comprising an internally threaded retaining ring adapted to be screwed onto said externally threaded part of said pipe section and having an internal shoulder at the end adapted to enter into bearing engagement with said external shoulder on said sleeve.

15. Electrostatic sprayer device for spraying products in powder form, comprising an air-powder mixture pipe, an ejector orifice at one end of said pipe, a charging electrode adjacent said orifice, a counter-electrode coaxial with and to the rear of said charging electrode relative to the direction in which said mixture is ejected from said pipe, external to said pipe and substantially perpendicular to the axis of said pipe whereby an annular space is defined around said pipe and extending from said counter-electrode towards said charging electrode, said electrodes being adapted to have a potential difference applied between them to generate an electric field adapted to attract free ions towards said counter-electrode, blower means adjacent said counter-electrode discharging into said annular space, and further comprising a tapered sleeve-skirt adapted to define a significantly reduced flow cross-section around said pipe and a circular row of holes in said sleeve-skirt adjacent said counter-electrode.

16. Device according to claim 15, wherein said pipe has a strongly tapered end section having a radially external frustoconical surface the generatrix of which is at an acute angle to the axial direction.

17. Device according to claim 16, wherein said acute angle is approximately 5°.

18. Device according to claim 16, wherein said sleeve-skirt has a tapered end section with a radially internal frustoconical surface substantially parallel to said radially external frustoconical surface of said end section of said pipe, whereby said two frustoconical surfaces constitute an exhaust nozzle.

19. Device according to claim 18, wherein said row of holes and said nozzle have respective total flow cross-sections that are substantially equal.

20. Device according to claim 15, wherein the diameter of said holes is between 1 mm and 4 mm.

21. Device according to claim 20, wherein the diameter of said holes is 3 mm.

22. An electrostatic spraying apparatus for spraying powder comprising:

(a) an air-powder mixture conduit having a downstream discharge end;

(b) a member having an inner surface coaxial with said air-powder mixture conduit thereby defining an annular space between said inner surface and said air-powder mixture conduit, said annular space having an upstream end portion and a downstream end portion;

(c) an ejector orifice at said discharge end of said air-powder mixture conduit;

(d) a charging electrode adjacent said ejector orifice;

(e) means for conducting air through said annular space; and (f) a counter-electrode having at least a portion through which said air passes and which is positioned in said upstream portion of said annular space.

23. The apparatus of claim 22 wherein said counter-electrode includes a surface which defines an upstream end of said annular space.

24. The apparatus of claim 22 wherein said counter-electrode comprises a downstream surface spaced from said charging electrode.

25. The apparatus of claim 22 wherein said air-powder mixture conduit comprises a longitudinal axis, and wherein said counter-electrode includes a surface communicating with said annular space which is substantially perpendicular to said longitudinal axis.

26. The apparatus of claim 22 wherein said annular space has a substantially constant dimension from said upstream end portion to said downstream end portion.

27. The apparatus of claim 22 wherein said annular space is tapered from said upstream portion to said downstream portion.

28. The apparatus of claim 27 wherein said member comprises a series of holes formed in its outer surface communicating with said annular space.

* * * * *